US008033296B2

(12) United States Patent
Chen

(10) Patent No.: US 8,033,296 B2
(45) Date of Patent: Oct. 11, 2011

(54) CONTROL MODULE FOR MULTI-NOZZLE SHOWER

(76) Inventor: Jeff Chen, Chiayi (TW)

( * ) Notice: Subject to any disclaimer, the term of this patent is extended or adjusted under 35 U.S.C. 154(b) by 744 days.

(21) Appl. No.: 12/163,209

(22) Filed: Jun. 27, 2008

(65) Prior Publication Data

US 2009/0320203 A1 Dec. 31, 2009

(51) Int. Cl.
*F16K 11/20* (2006.01)

(52) U.S. Cl. ..... 137/883; 251/232

(58) Field of Classification Search ..... 137/883; 251/232, 319; 4/601
See application file for complete search history.

(56) References Cited

U.S. PATENT DOCUMENTS 3,112,656 A * 12/1963 Cary et al. ..... 74/471 R
4,129,150 A * 12/1978 Boisserand ..... 137/872
4,498,500 A * 2/1985 Miller ..... 137/883
4,597,723 A * 7/1986 Sember et al. ..... 417/440
4,854,499 A * 8/1989 Neuman ..... 236/93 B
5,121,511 A * 6/1992 Sakamoto et al. ..... 4/601
5,321,860 A * 6/1994 Steinhardt et al. ..... 4/601
5,428,850 A * 7/1995 Hiraishi et al. ..... 4/601
5,499,657 A * 3/1996 Schmitt ..... 137/887
6,227,456 B1 * 5/2001 Colman ..... 239/1

* cited by examiner

*Primary Examiner* — John Fox
(74) *Attorney, Agent, or Firm* — C. G. Mersereau; Nikolai & Mersereau, P.A.

(57) ABSTRACT

A control module for a multi-nozzle shower has a body, a control panel and a controlling assembly. The body is mounted securely in the shower and defines at least one chamber having valve seats, at least one inlet and multiple outlets respectively communicating with the nozzles. The control panel is mounted securely on the body and seals the at least one chamber. The controlling assembly is mounted in the control panel and has multiple valve disks and buttons. The valve disks selectively block the valve seats to stop water flow. The buttons connected to the valve disks and are arranged on the control panel and selectively actuate the valve disks to block the valve seats. Thereby, people can conveniently control water discharged from different nozzles or showerheads of the shower.

6 Claims, 10 Drawing Sheets

CONTROL MODULE FOR MULTI-NOZZLE SHOWER

BACKGROUND OF THE INVENTION

1. Field of the Invention

The present invention relates to a control module, and more particularly to a control module for a multi-nozzle shower to facilitate control of water being discharged from different nozzles.

2. Description of Related Art

Showers are implemented in spas, swimming pools, bathrooms, toilets and the like for cleaning a body. A conventional shower typically has one nozzle that sprays water down on the body and may be a fixed showerhead or a hand showerhead.

With technology developing, various types of showers including shower curtains, sensor-operated column showers and the like are provided. Many showers are provided with multiple nozzles that are separately arranged to spray different portions of the body for improved shower control.

Generally, the nozzles of a shower are respectively controlled by multiple faucets or switches being mounted respectively adjacent to the nozzles. Such that when operating the shower, people have to separately turn on and off the faucets or switches. This is confusing, inconvenient and requires improvement.

The present invention therefore provides a control module for a multi-nozzle shower to obviate or mitigate the aforementioned problems.

SUMMARY OF THE INVENTION

The main objective of the present invention is to provide a control module for a multi-nozzle shower that facilitates control of water discharge from different nozzles of a shower for greater convenience.

To achieve the objective, the control module for a multi-nozzle shower comprises a body, a control panel and a controlling assembly. The body is mounted securely in the shower and defines at least one chamber having multiple valve seats, at least one inlet and multiple outlets respectively communicating with the nozzles. The control panel is mounted securely on the body and seals the at least one chamber of the body. The controlling assembly is mounted in the control panel and has multiple valve disks and buttons. The valve disks selectively block the valve seats to stop water flow. The buttons are connected to the valve disks and are arranged on the control panel and selectively actuate the valve disks to block the valve seats.

Thereby, people can conveniently control water discharged from different nozzles or showerheads of the shower.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
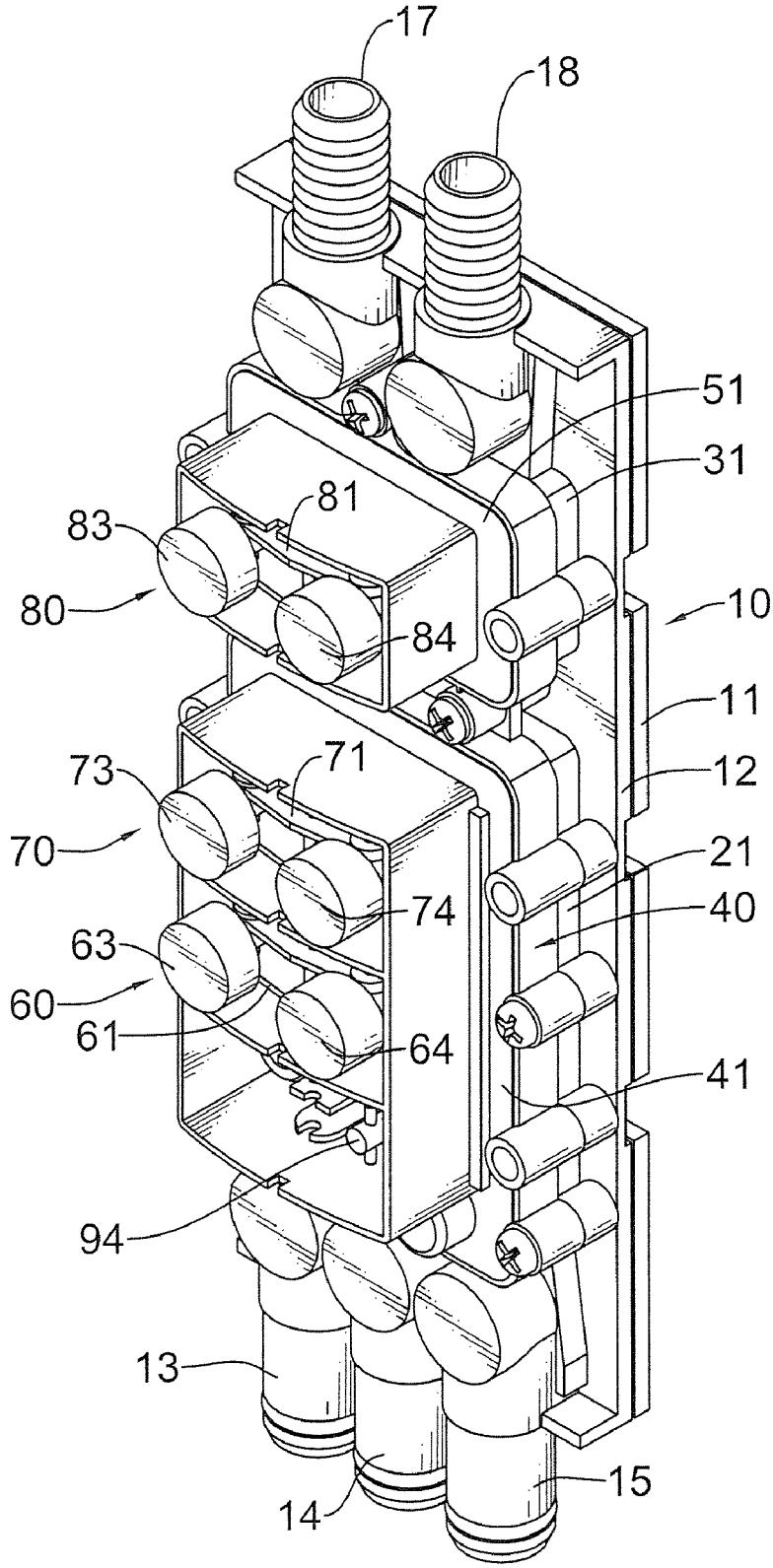
FIG. 1 is a perspective view of a control module for a multi-nozzle shower in accordance with the present invention.
Figure 2:
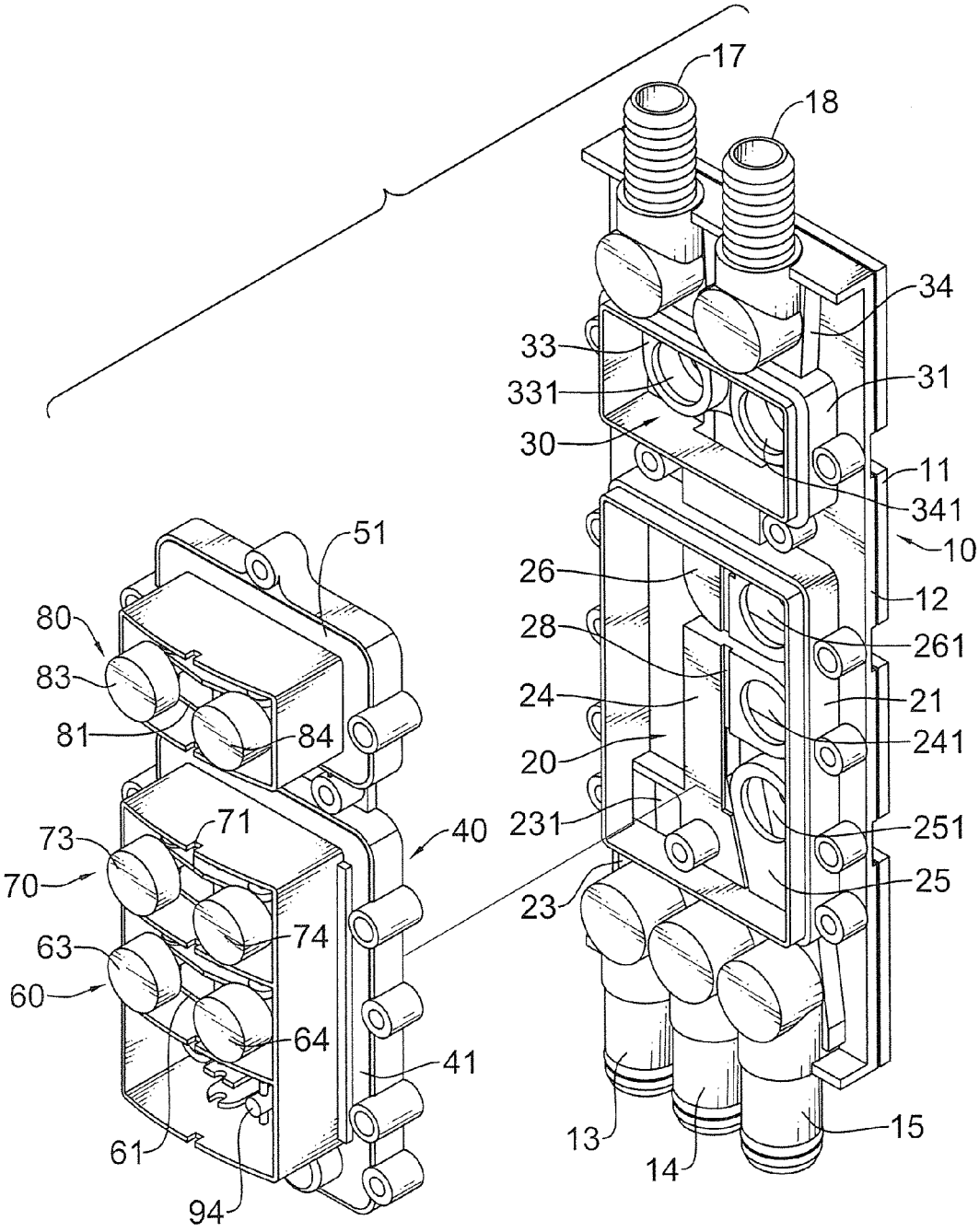
FIG. 2 is an exploded perspective view of the control module in FIG. 1.
Figure 3:
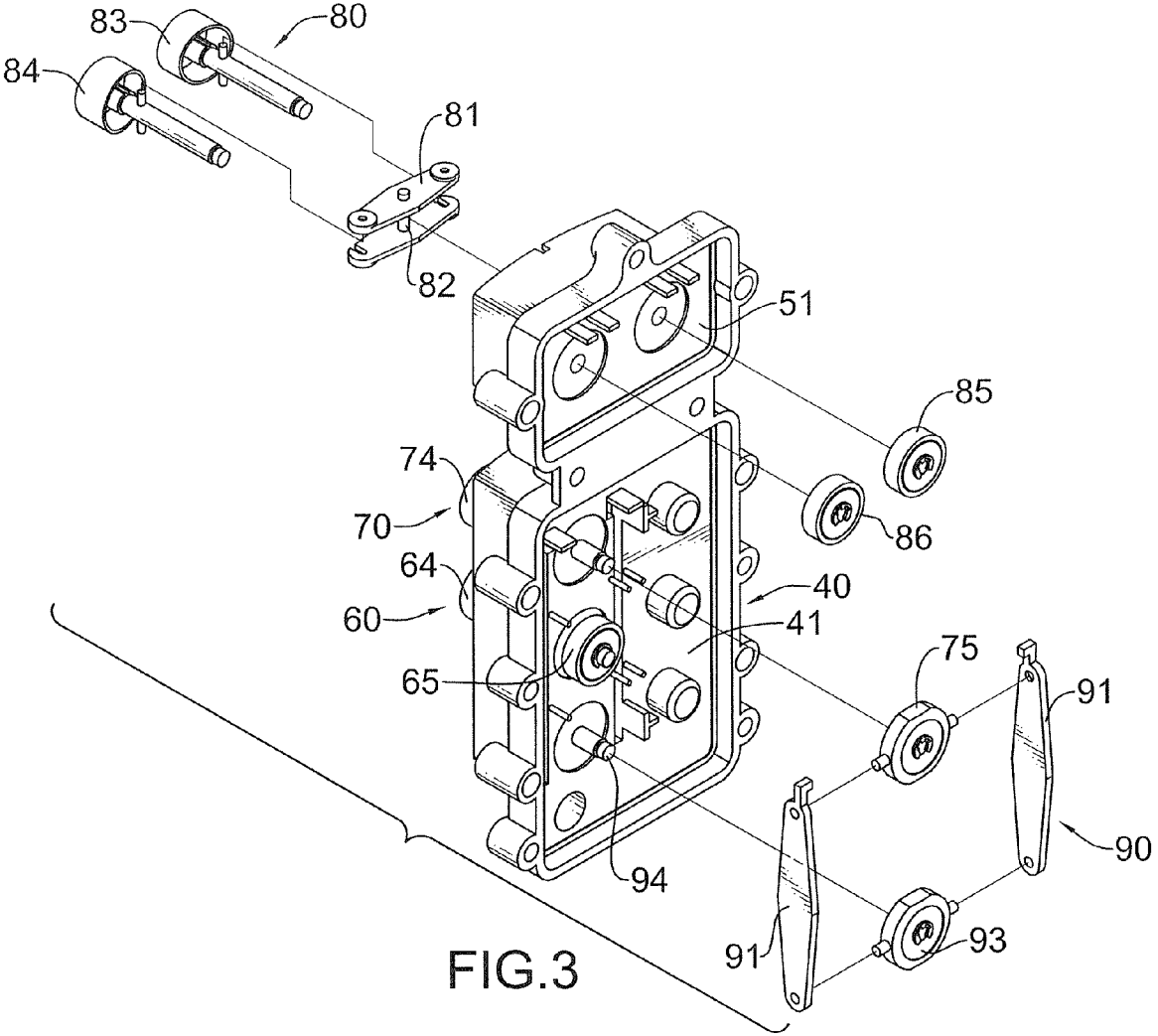
FIG. 3 is a partially exploded perspective view of the control module in FIG. 1.

With reference to FIGS. 1 3, 5 and 6, the control module for a multi-nozzle shower in accordance with present invention comprises a body (10), a control panel (40) and a controlling assembly.

The body (10) has multiple connectors, at least one chamber comprising a main chamber (20) and an optional alternate chamber (30) and the body (10) may be formed by assembly of a base panel (11) and a covering panel (12).

The multiple connectors are mounted on the body for connection to a nozzle and comprise at least one inlet connector (13), an independent connector (14), an ancillary connector (15) and at least one alternative connector (17, 18).

The main chamber (20) is defined in the body (10) and comprises a main wall (21), at least one inlet (23), multiple outlets (24, 25, 26), multiple valve seats (241, 251, 261) and multiple grooves (28). The at least one inlet (23) is formed through the main wall (21) and communicates with the main chamber (20) and may have an inlet hole (231) being formed in the main chamber (20). The outlets (24, 25, 26) are formed through the outer wall, communicate respectively with the connectors and may comprise outlet pipes being respectively formed in the main chamber of the body between the main wall (21) and the valve seat (241, 251, 26 1) and the outlets comprise an independent outlet (24), an ancillary outlet (25) and an alternative outlet (26). The alternative outlet (26) may communicate directly with the at least one alternative connector (17). The valve seats (241, 251, 261) correspond to and are formed in the corresponding outlets(24, 25, 26) and comprise an independent seat (241), an ancillary seat (251) and an alternative seat (261).

The second chamber (30) is defined in the body (10) adjacent to the main chamber (20), may be formed by a partition of the main chamber (20) or may be formed independently and selectively communicates with the main chamber (20) through an inlet being the alternative outlet (26) and comprises an alternative wall (31), multiple selector outlets (33, 34) and multiple selector valve seats (331, 341). The selector outlets (33,34) are formed through the alternative wall (31) and communicate respectively with the alternative connectors (17, 18) and may comprise outlet pipes. The outlet pipes of the selector outlets (33, 34) are formed in the alternative chamber (30) between the alternative wall (31) and the selector valve seats (331, 332). The selector valve seats (331, 341) correspond to and are formed respectively in the selector outlets (33, 34).

The covering panel (12) may define the inlet and outlet pipes.

The control panel (40) is mounted securely on the body (10) to seal the first chamber (20) and the second chamber (30) of the body (10) and comprises multiple sealing panels (41, 51), multiple lever mounts (45, 54) and multiple mounting holes. Each of the sealing panels (41, 51) has a front surface and a rear surface. The rear surfaces of the sealing panels (41, 51) are mounted securely on the first and the second walls (21, 31) in a watertight manner. The lever mounts (45, 54) protrude from the front surfaces of the sealing panels (41, 51). The mounting holes are formed through the sealing panels (41, 51) corresponding respectively to the valve seats (241, 251, 261, 331, 341).

The controlling assembly is mounted in the control panel (40) and comprises multiple switches (60, 70, 80) and an inverter (90). Each switch (60, 70, 80) comprises two buttons (63, 64, 73, 74, 83, 84), at least one valve disk (65, 75, 85, 86) and a lever (61, 71, 81) and the switches (60, 70, 80) may be an independent switch (60), an alternative switch (70), a selector switch (80) and an optional ancillary switch. The buttons (63, 64, 73, 74, 83, 84) respectively correspond to two adjacent mounting holes in the sealing panels (41, 51) of the control panel (40) and each has a shaft having an end being mounted through a corresponding mounting hole of the control panel (40). The at least one valve disk (65, 75, 85, 86) is attached securely to the end of at least one shaft of the buttons (63, 64, 73, 74, 83, 84), and corresponds respectively to and selectively blocks the valve seats (241, 261, 331, 341) and may comprise an independent valve disk (65), an alternative valve disk (75) and two selector valve disks (86). The lever (61, 71, 81) is pivotally mounted in the control panel (40), has a central pin (62, 72, 82) that is selectively mounted pivotally in a corresponding lever mount (45, 54) of the control panel (40) and two ends that are pivotally connected respectively to the shafts of the buttons (63, 64, 73, 74, 83, 84), thereby the buttons (63, 64, 73, 74, 83, 84) perform contrary motion.

The inverter (90) comprises a sliding bar (94), an ancillary valve disk (93) and two couples (91). The sliding bar (94) is mounted slidably in the control panel (40), may be in the sealing panel (41) has an end and may be a shaft of the ancillary switch. The ancillary valve disk (93) is attached to the end of the sliding bar (94) and corresponds to one of the valve seats, may be to the ancillary valve seat (251). The couples (91) are respectively mounted pivotally in the grooves (28) of the main chamber (20) and have two ends pivotally connected respectively to the alternative valve disk (75) and the ancillary valve disk (93), thereby the valve disk (75) and the ancillary valve disk (93) perform contrary motion.

Figure 4:
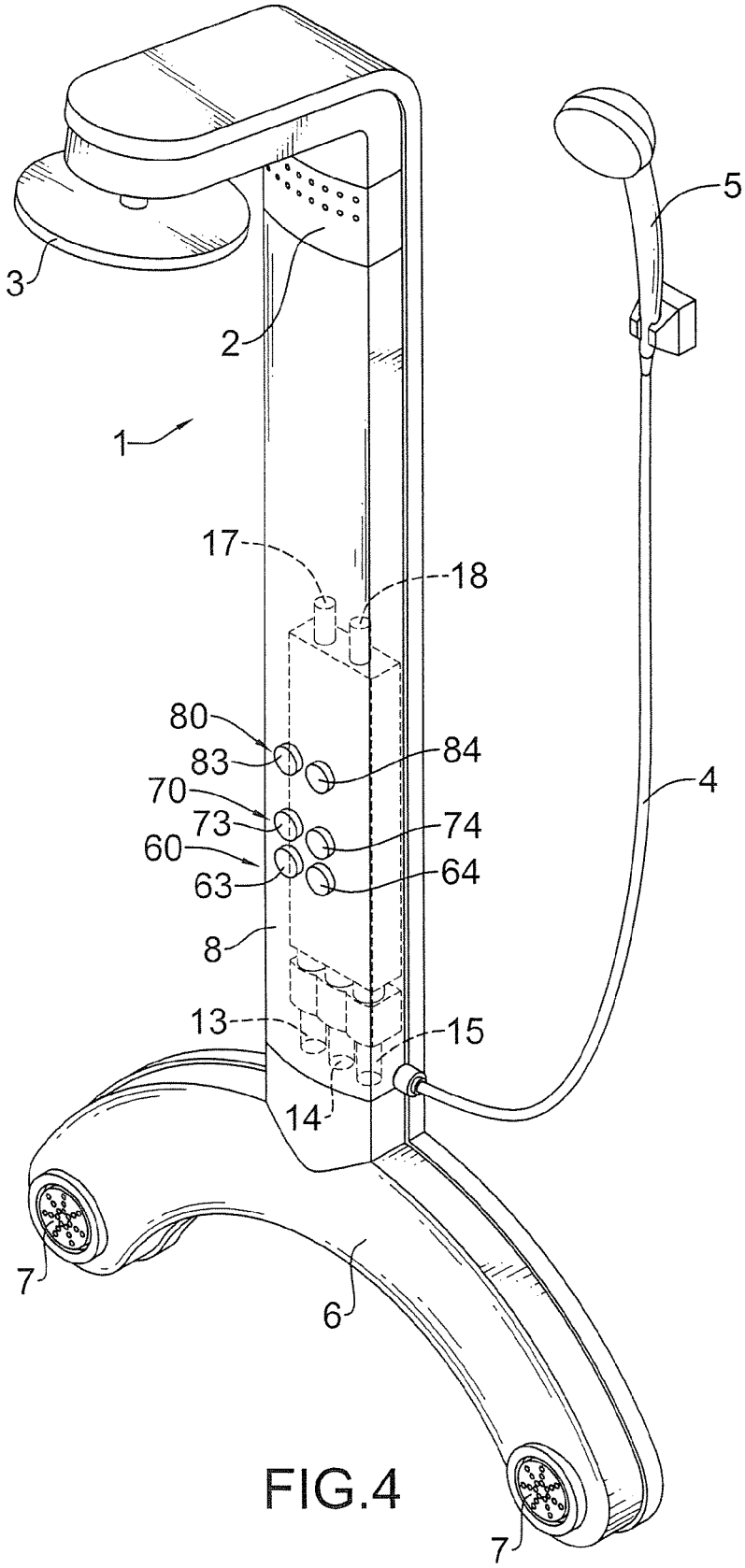
FIG. 4 is an operational perspective view of the control module in FIG. 1, shown partially in phantom lines mounted in a multi-nozzle shower.
Figure 6:
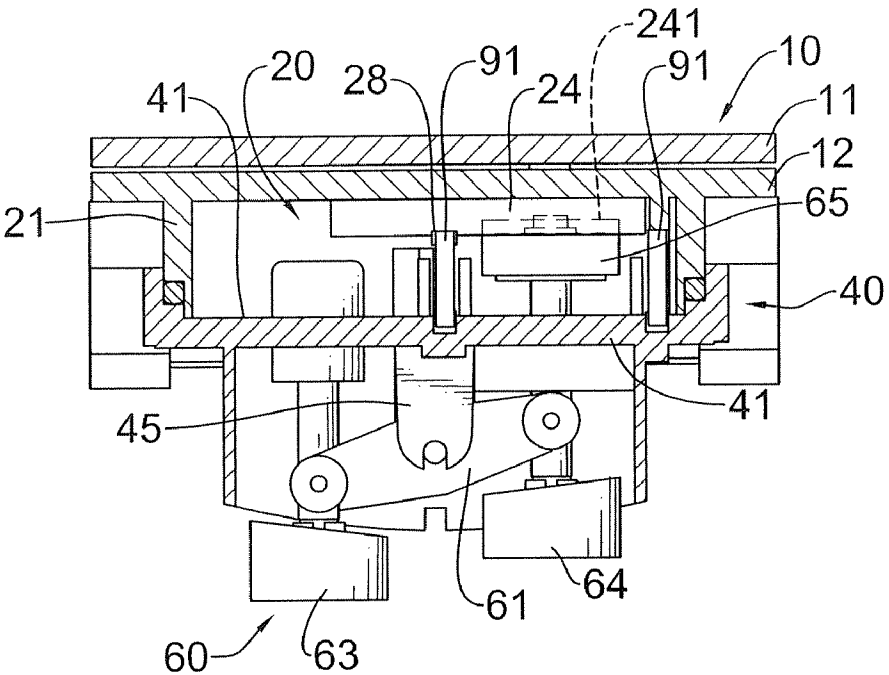
FIG. 6 is an operational top view in partial section of the control module in FIG. 5.
Figure 5:
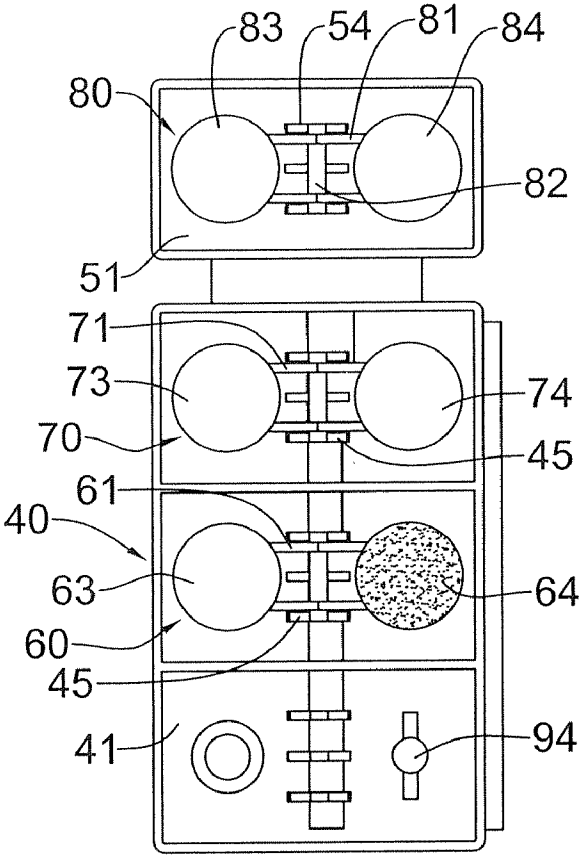
FIG. 5 is a front view of a control panel of the control module in FIG. 1, the black shading representing a depressed button in a first operational embodiment.

With further reference to FIG. 4, the control module in accordance with present invention may be mounted in a shower (1) with a cover (8) covering on the control module and allowing the buttons (63, 64, 73, 74, 83, 84) to selectively protrude out. The shower (1) has two showerheads (2,3) in a top of the shower (1), multiple body sprays (7) and a hand shower (5). The showerheads (2, 3) are respectively connected to the alternative connectors (17, 18) of the control module and may be alternately selected using the selector switch (80). The body sprays (7) are connected to the independent connector (14) and may be selectively turned on using the independent switch (70). The hand shower (5) comprises a flexible pipe (4) that is connected to the ancillary connector (15). The at least one inlet connector (13) is connected to a water supply pipe that may supply hot or cold water and may supply pressurized water.

Figure 8:
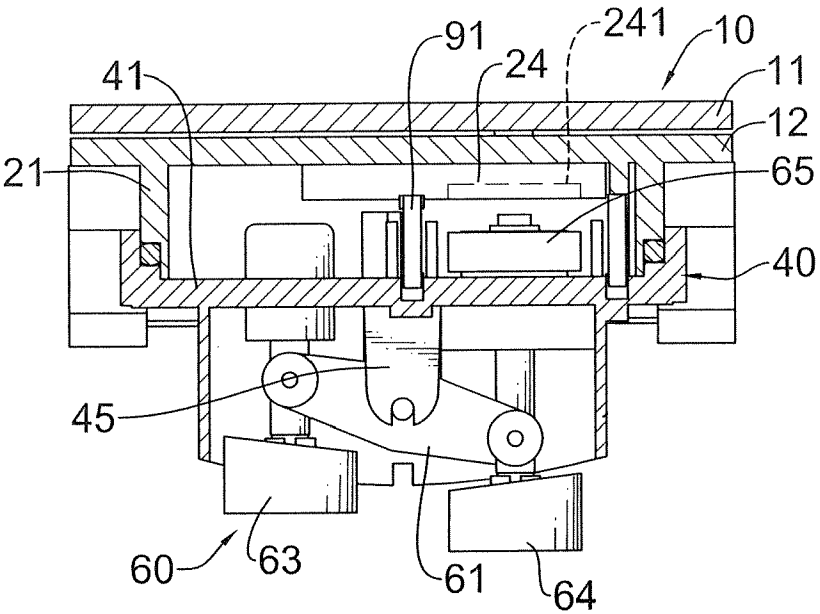
FIG. 8 is an operational top view in partial section of the control module in FIG. 7.
Figure 7:
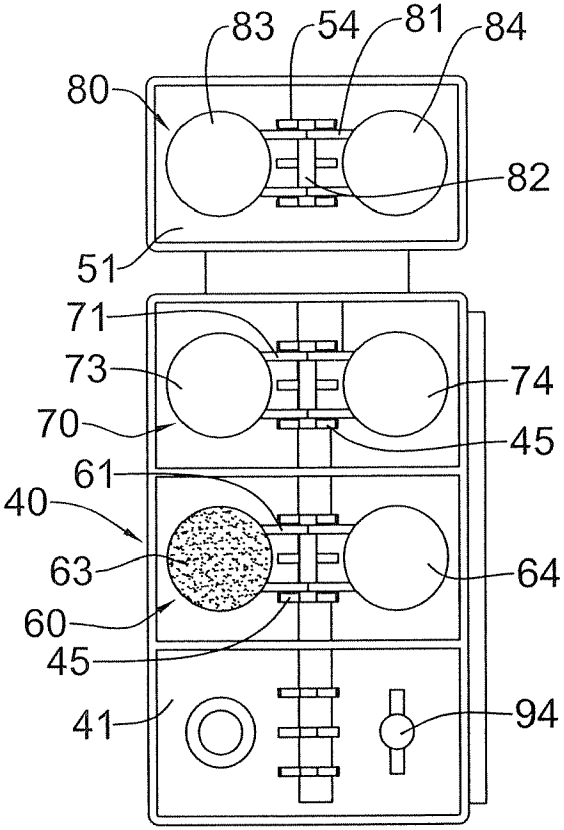
FIG. 7 is an operational front view of a control panel of the control module in FIG. 1, the black shading representing a depressed button in a second operational embodiment.

When in use, pressing the buttons (63, 64, 73, 74, 83, 84) controls water discharged from the showerheads (2, 3), body sprays (7) and hand shower (5). With further reference to FIGS. 7 and 8, the independent switch (63, 64) is used to open and close the lower valve seat (241) via the independent valve disk (65). When open, the independent valve seat (241) allows water inside the first chamber (20) to flows through the independent outlet (14) and be discharged from the body sprays (7).

Figure 10:
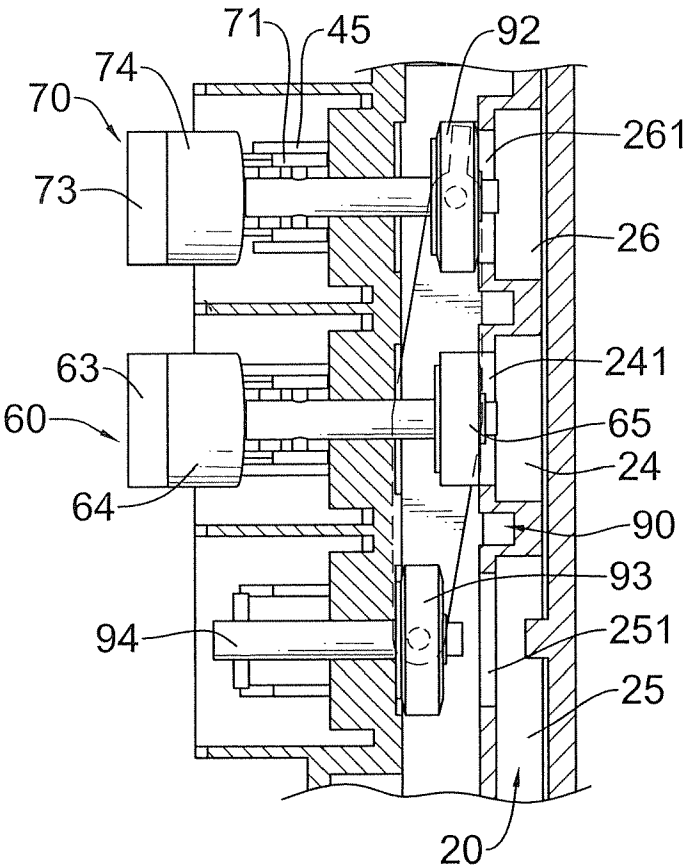
FIG. 10 is an operational partial side view in partial section of the control module in FIG. 9.
Figure 9:
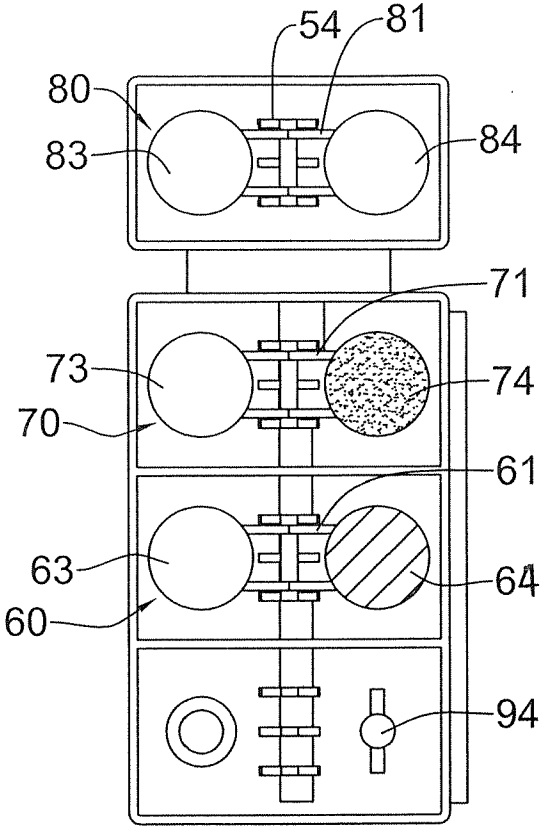
FIG. 9 is an operational front view of a control panel of the control module in FIG. 1, the black shading representing a depressed button in a third operational embodiment and the hatched shading showing an optional position.

With further reference to FIGS. 9 and 10, since the independent valve disk (65) is independent, it may close or open the independent valve seat (241) in the following examples.

When the button (74) is actuated to close the alternative valve seat (261), the couples (91) open the ancillary valve disk (93) and the ancillary valve seat (251) is opened. Then the water inside the first chamber (20) flows through the ancillary output (25) through the ancillary connector (15) to be discharged from the hand shower (5).

Figure 12:
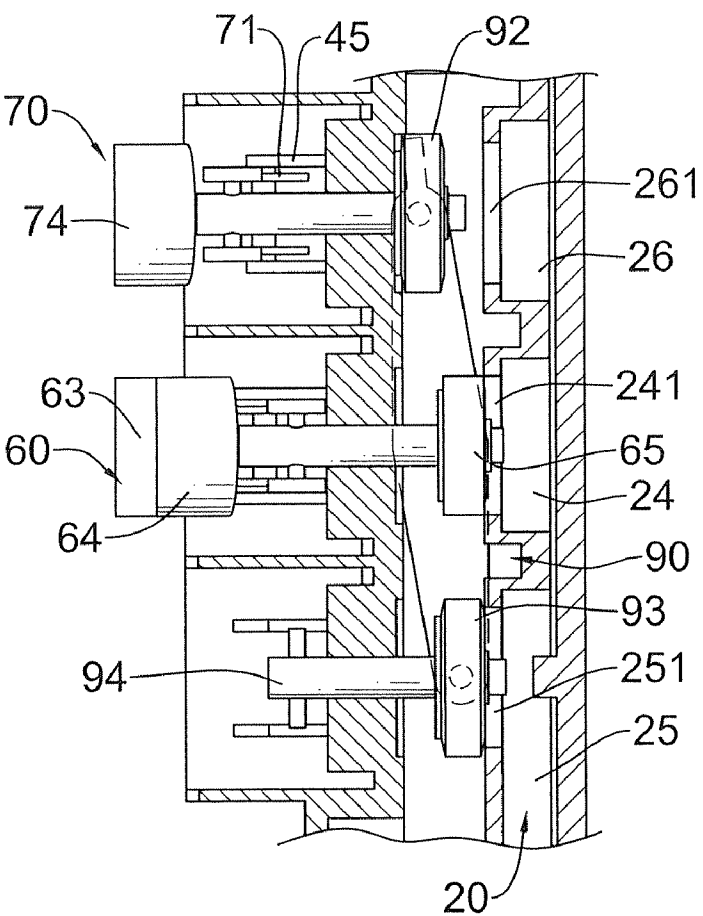
FIG. 12 is an operational partial side view in partial section of the control module in FIG. 11.
Figure 11:
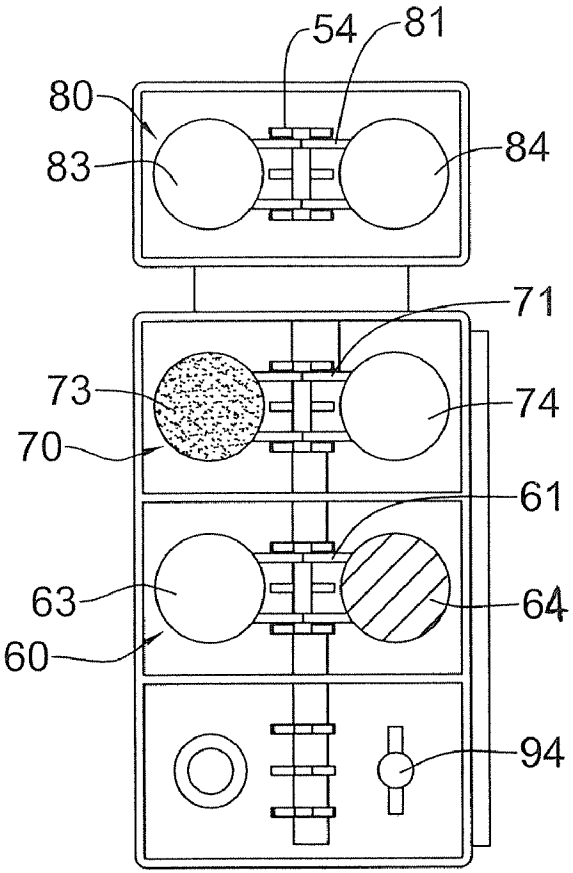
FIG. 11 is an operational front view of a control panel of the control module in FIG. 1, the black shading representing a depressed button in a forth operational embodiment and the hatched shading showing an optional position.
Figure 14:
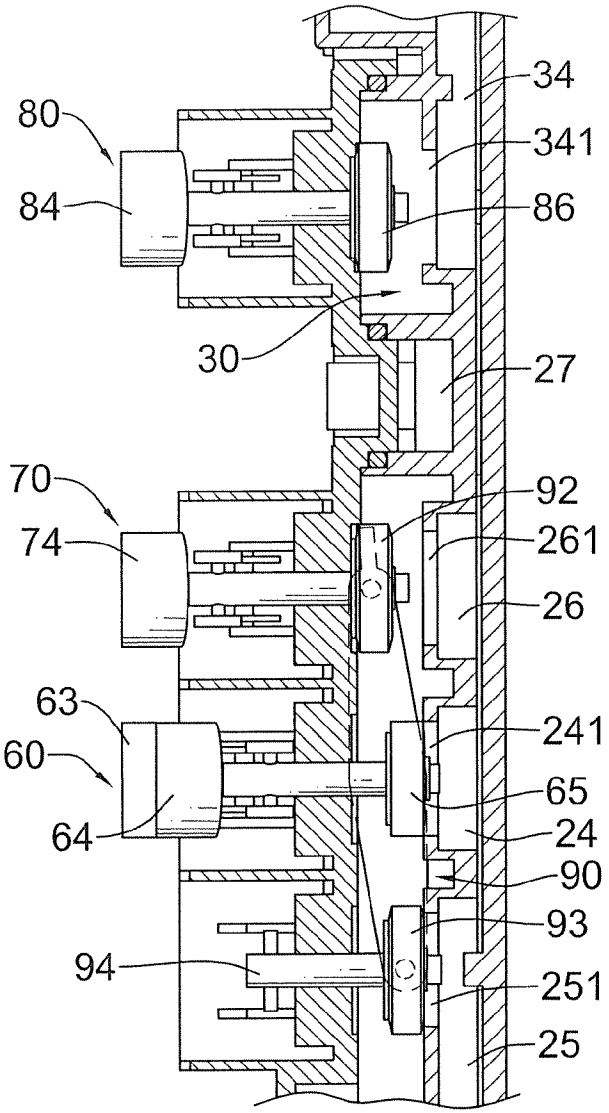
FIG. 14 is an operational side view in partial section of the control module in FIG. 13.
Figure 13:
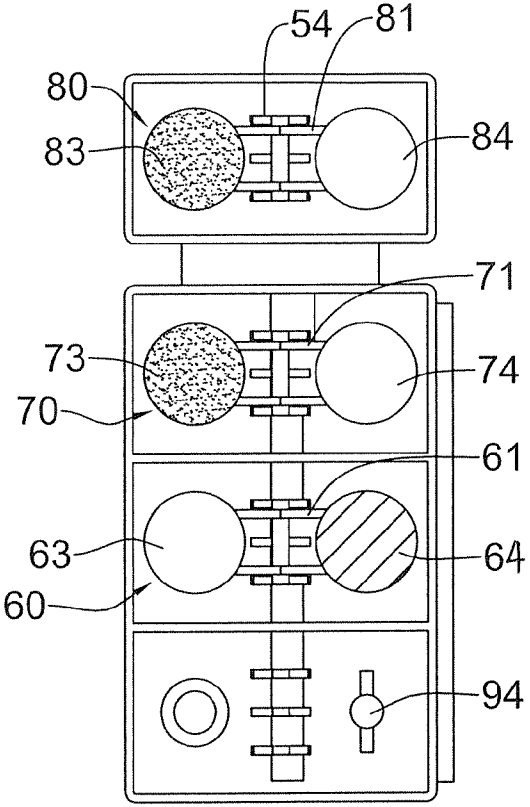
FIG. 13 is an operational front view of a control panel of the control module in FIG. 1, the black shading representing a depressed button in a fifth operational embodiment and the hatched shading showing an optional position.
Figure 16:
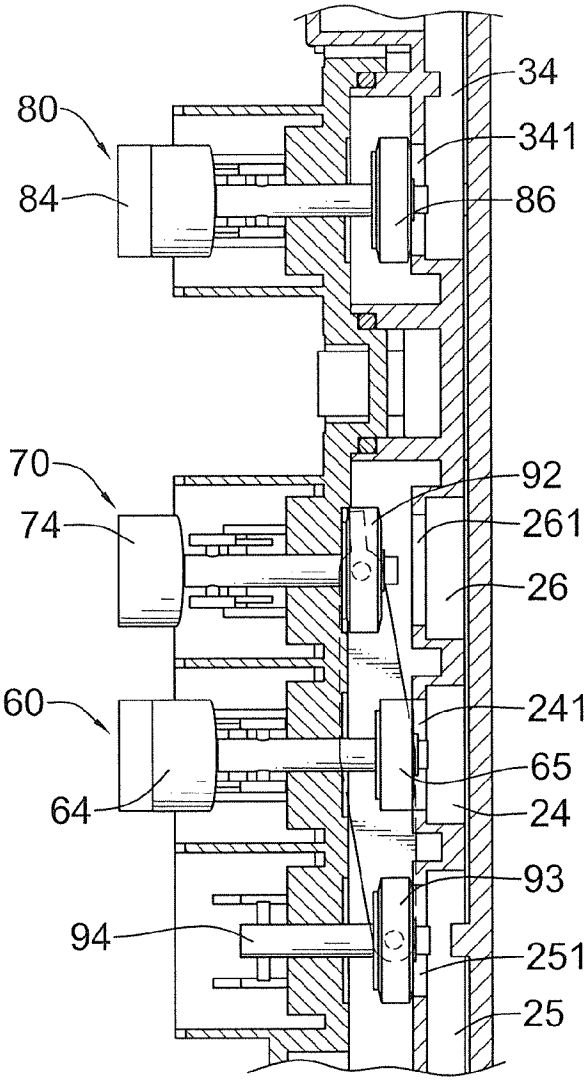
FIG. 16 is an operational side view in partial section of the control module in FIG. 15.
Figure 15:
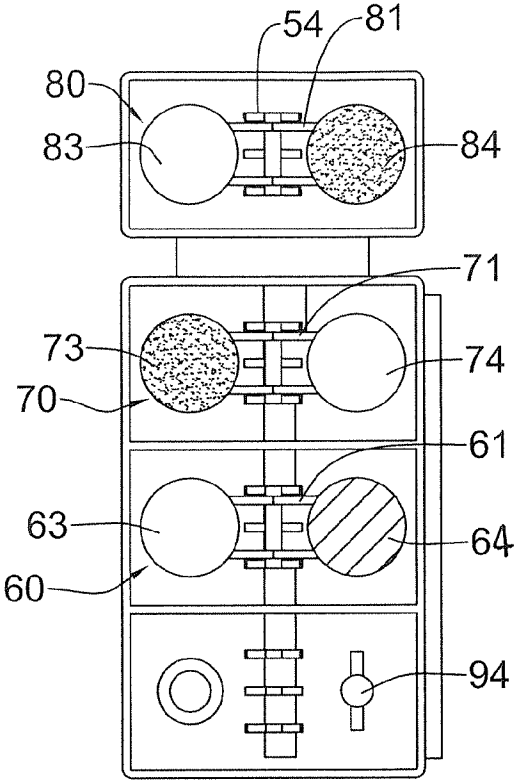
FIG. 15 is an operational front view of a control panel of the control module in FIG. 1, the black shading representing a depressed button in a sixth operational embodiment and the hatched shading showing an optional position.

With further reference to FIGS. 11 and 12, the button (73) can be pressed to open the alternative valve seat (261) and allows water in the first chamber (20) to flow into the second chamber (30) through the alternative output (26).

With further reference to FIGS. 13 to 16, the selector switch (80) is toggled to select the alternative connectors (17, 18) to discharge water through the showerheads (2, 3).

Therefore, by pressing different buttons (63, 64, 73, 74, 83, 84), the water being discharged from the showerheads (2, 3), the body sprays (7) and the hand shower (5) can be simply controlled.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A control module for a multi-nozzle shower comprising a body has multiple connectors being mounted on the body;

at least one chamber being defined in the body;

at least one inlet communicating with the at least one chamber;

multiple outlets communicating the at least one chamber and respectively with the connectors; and multiple valve seats corresponding to and being formed in the outlets;

a control panel being mounted securely on the body to seal the at least one chamber of the body and having multiple mounting holes; and a controlling assembly being mounted in the control panel and comprising multiple switches, each switch comprising two buttons, each having a shaft having an end being mounted through a corresponding one of the mounting holes of the control panel;

at least one valve disk being attached securely to the end of at least one of the shafts of one buttons, corresponding to and selectively blocking at least one valve seat of the body; and a lever being pivotally mounted in the control panel, having a central pin being pivotally mounted in the control panel and two ends being connected respectively to the shafts of the buttons, thereby performing contrary motion.

2. The control module for a multi-nozzle shower as claimed in claim 1, wherein the body has multiple chambers including a main chamber being defined in the body and comprising a main wall; and the outlets are formed through the main wall, wherein at least one of the outlets is an alternative outlet; and an alternate chamber being defined in the body adjacent to the main chamber and comprising an alternative wall;

multiple selector outlets being formed through the alternative wall and communicating respectively with the connectors; and multiple selector valve seats corresponding to and being formed respectively in the selector outlets.

3. The control module for a multi-nozzle shower as claimed in claim 2, wherein the at least one inlet has an inlet hole being formed in the main chamber of the body; and the outlets further comprise outlet pipes being respectively formed in the main chamber and the alternate chamber.

4. The control module for a multi-nozzle shower as claimed in claim 3, wherein the connectors of the body comprise an inlet connector communicating with the main chamber of the body;

an independent connector communicating with the main chamber through an independent outlet;

an auxiliary connector communicating with the main chamber through an auxiliary outlet; and multiple alternative connectors communicating with the alternative chamber.

5. The control module for a multi-nozzle shower as claimed in claim 4, wherein the valve disks comprise an independent valve disk, an alternative valve disk and two selector valve disks;

the main chamber further comprises multiple grooves; and the controlling assembly further has an inverter comprising a sliding bar being mounted slidably in the control panel and having an end;

an ancillary valve disk being attached to the end of the sliding bar and corresponding to one of the valve seats; and two couples being pivotally mounted in the grooves of the main chamber and having two ends pivotally connected respectively to the alternative valve disk and the ancillary valve disk, thereby the alternative valve disk and the ancillary valve disk perform contrary movements.

6. The control module for a multi-nozzle shower as claimed in claim 5, wherein the control panel further has multiple sealing panels corresponding respectively to the main chamber and the alternative chamber, each of the sealing panels having a front surface; and a rear surface being mounted securely on the body in a watertight manner, wherein the mounting holes are formed through the sealing panels.

* * * * *